US011509082B2

(12) United States Patent
Ishikawa et al.

(10) Patent No.: US 11,509,082 B2
(45) Date of Patent: Nov. 22, 2022

(54) CIRCUIT BOARD CABLE CONNECTOR WITH MORE THAN ONE MOUNTING CONFIGURATION

(71) Applicant: Molex, LLC, Lisle, IL (US)

(72) Inventors: Atsushi Ishikawa, Yamato (JP); Ayako Matsumoto, Yamato (JP); Ryosuke Watanabe, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 17/335,110

(22) Filed: Jun. 1, 2021

(65) Prior Publication Data

US 2021/0391662 A1 Dec. 16, 2021

(30) Foreign Application Priority Data

Jun. 11, 2020 (JP) ..... JP2020-101894

(51) Int. Cl.
*H01R 12/75* (2011.01)
*H01R 4/18* (2006.01)

(52) U.S. Cl.
CPC ..... *H01R 12/75* (2013.01); *H01R 4/18* (2013.01)

(58) Field of Classification Search
CPC ..... H01R 12/75; H01R 12/716; H01R 12/52; H01R 12/714; H01R 12/73; H01R 12/737; H01R 4/18
See application file for complete search history.

(56) References Cited

U.S. PATENT DOCUMENTS 3,596,235 A * 7/1971 Teurlings ..... H01R 12/85 439/907
4,668,040 A * 5/1987 Matsuzaki ..... H01R 12/7029 439/571
9,806,442 B2 * 10/2017 Geske ..... H01R 12/716

FOREIGN PATENT DOCUMENTS

JP 2017010610 A 1/2017
JP 6440345 B2 12/2018

* cited by examiner

*Primary Examiner* — Vanessa Girardi

(57) ABSTRACT

To provide a connector for which cost can be reduced. A first connector 1 includes first metal members 10A that function as terminals and second metal members 10B that function as reinforcing brackets. Each first metal member 10A and second metal member 10B include a main body part 11, a first edge part 15, a second edge part 16, and a third edge part 17. A first edge part 15 of the first metal member 10A is positioned on the upper side of the main body part 11 that is the side that receives the mating connector. The second metal member 10B is retained in a different orientation from the first metal member 10A. The first edge part 15 of the second metal member 10B is positioned below the main body part 11 of the second metal member 10B and can be attached to a first circuit board B1 arranged on the lower side of the first connector 1. The third edge part 17 of the second metal member 10B is positioned more in the Y1 direction than the main body part 11 of the second metal member 10B and can be attached to the second circuit board B2 arranged in the Y1 direction with respect to the first connector 1.

12 Claims, 11 Drawing Sheets

CIRCUIT BOARD CABLE CONNECTOR WITH MORE THAN ONE MOUNTING CONFIGURATION

RELATED APPLICATION

The present application claims priority to Japanese Patent Application No. 2020-101894 filed Jun. 11, 2020 which is incorporated by reference in its entirety.

TECHNICAL FIELD

The present disclosure is related to a connector that can be mounted on a circuit board in two mutually different orientations, and to a connector assembly.

BACKGROUND ART

Patent Document 1 discloses a connector that can be attached to a circuit board in both a vertical orientation and a horizontal orientation in a connector that connects a cable to a circuit board. When the connector is in a vertical orientation, the connection direction between the connector provided at the end of the cable and the connector on the circuit board is perpendicular to the circuit board. When the connector is in a horizontal orientation, the connection direction between the connector provided at the end of the cable and the connector on the circuit board is parallel to the circuit board. With this connector, a connector for connecting a cable to the circuit board in the vertical direction and a connector for connecting a cable to the circuit board in the horizontal direction do not need to be designed or manufactured separately and this enables cost reduction of the connector.

Prior Art Documents; Patent Documents; Patent Document 1: Japanese Patent Number 6440345

SUMMARY

The connector mounted on the circuit board includes not only a terminal that establishes an electrical connection with the cable, but also a reinforcing bracket for increasing securing strength of the connector to the circuit board. The reinforcing bracket is retained at the end of the housing and soldered to the circuit board. In the structure of conventional terminals and reinforcing brackets, there is a problem in that further cost reduction is difficult.

An example of a connector proposed in the present disclosure is a connector that includes a first metal member that functions as a terminal, a second metal member that functions as a reinforcing bracket, and a housing that retains the first metal member and the second metal member, and that connects with a mating connector in a first axis direction. Each of the first metal member and the second metal member has a main body part, a first edge part, a second edge part, and a third edge part, the body part of the first metal member includes a portion in contact with a mating terminal, and the first edge of the first metal member is positioned in a first direction that is one direction in the first axis direction from the main body part. The second edge of the first metal member is positioned in a second direction opposite to the first direction that is in the first axis direction from the main body part and can be connected to a first circuit board arranged in the second direction of the connector. The third edge of the first metal member is positioned in a third direction that is one direction in a second axial direction orthogonal to the first axis direction from the main body part and can be connected to a second circuit board arranged in the third direction of the connector. The second metal member is retained in a different orientation from the first metal member. The first edge of the second metal member is positioned in the second direction from the main body part of the second metal member and can be attached to the first circuit board arranged in the second direction with respect to the connector. The third edge of the second metal member is positioned in the third direction from the main body part of the second metal member and can be attached to the second circuit board arranged in the third direction with respect to the connector. The second edge of the second metal member is positioned in the first direction from the main body part of the second metal member.

An example of a connector proposed in the present disclosure is a connector that includes a first metal member that functions as a terminal, a second metal member that functions as a reinforcing bracket, and a housing that retains the first metal member and the second metal member, and that connects with a mating connector in a first axis direction. Each of the first metal member and the second metal member includes a main body part, a first edge, a second edge, and a third edge. The main body part of the first metal member includes a portion in contact with a mating terminal. The first edge of the first metal member is positioned in a first direction that is one direction in the first axis direction from the main body part. The second edge of the first metal member is positioned in a second direction opposite to the first direction that is in the first axis direction from the main body part and can be connected to a first circuit board arranged in the second direction of the connector. The third edge of the first metal member is positioned in a third direction that is one direction in a second axial direction orthogonal to the first axis direction from the main body part and can be connected to a second circuit board arranged in the third direction of the connector. The second metal member is retained in a different orientation from the first metal member. The first edge of the second metal member is positioned in the third direction from the main body part of the second metal member and can be attached to the second circuit board arranged in the third direction with respect to the connector. The third edge of the second metal member is positioned in the second direction with respect to the main body part of the second metal member and can be attached to the first circuit board arranged in the second direction with respect to the connector. The third edge of the second metal member is positioned in the fourth direction that is opposite to the third direction in the second axis direction from the main body part of the second metal member.

An example of a connector assembly proposed in the present disclosure is a connector assembly having a first connector and a second connector that mates with the first connector in a first direction. The first connector includes a first metal member that functions as a terminal, a second metal member that functions as a reinforcing bracket, and a housing that retains the first metal member and the second metal member. Each of the first metal member and the second metal member includes a main body part, a first edge, a second edge, and a third edge. The main body part of the first metal member includes a portion in contact with a terminal of the second connector. The first edge of the first metal member is positioned in a first direction that is one direction in the first axis direction from the main body part. The second edge of the first metal member is positioned in a second direction opposite to the first direction in the first axis direction from the main body part and can be connected to the first circuit board arranged in the second direction of the first connector. The third edge of the first metal member is positioned in a third direction that is one direction in a second axial direction orthogonal to the first axis direction from the main body part and can be connected to the second circuit board arranged in the third direction of the first connector. The second metal member is retained in a different orientation from the first metal member. The first edge of the second metal member is positioned in the second direction from the main body part of the second metal member and can be attached to the first circuit board arranged in the second direction with respect to the first connector. The third edge of the second metal member is positioned in the third direction from the main body part of the second metal member and can be attached to the second circuit board arranged in the third direction with respect to the first connector. The second edge of the second metal member is positioned in the first direction from the main body part of the second metal member.

An additional example of a connector assembly proposed in the present disclosure is a connector assembly having a first connector and a second connector that mates with the first connector in a first direction. The first connector includes a first metal member that functions as a terminal, a second metal member that functions as a reinforcing bracket, and a housing that retains the first metal member and the second metal member. Each of the first metal member and the second metal member includes a main body part, a first edge, a second edge, and a third edge. The main body part of the first metal member includes a portion in contact with a terminal of the second connector. The first edge of the first metal member is positioned in a first direction that is one direction in the first axis direction from the main body part. The second edge of the first metal member is positioned in a second direction opposite to the first direction in the first axis direction from the main body part and can be connected to the first circuit board arranged in the second direction of the first connector. The third edge of the first metal member is positioned in a third direction that is one direction in a second axial direction orthogonal to the first axis direction from the main body part and can be connected to the second circuit board arranged in the third direction of the first connector. The second metal member is retained in a different orientation from the first metal member. The first edge of the second metal member is positioned in the third direction from the main body part of the second metal member and can be attached to the second circuit board arranged in the third direction with respect to the first connector. The third edge of the second metal member is positioned in the second direction with respect to the main body part of the second metal member and can be attached to the first circuit board arranged in the second direction with respect to the first connector. The third edge of the second metal member is positioned in the fourth direction that is opposite to the third direction in the second axis direction from the main body part of the second metal member.

DETAILED DESCRIPTION OF THE PREFERRED EMBODIMENTS

Figure 1:
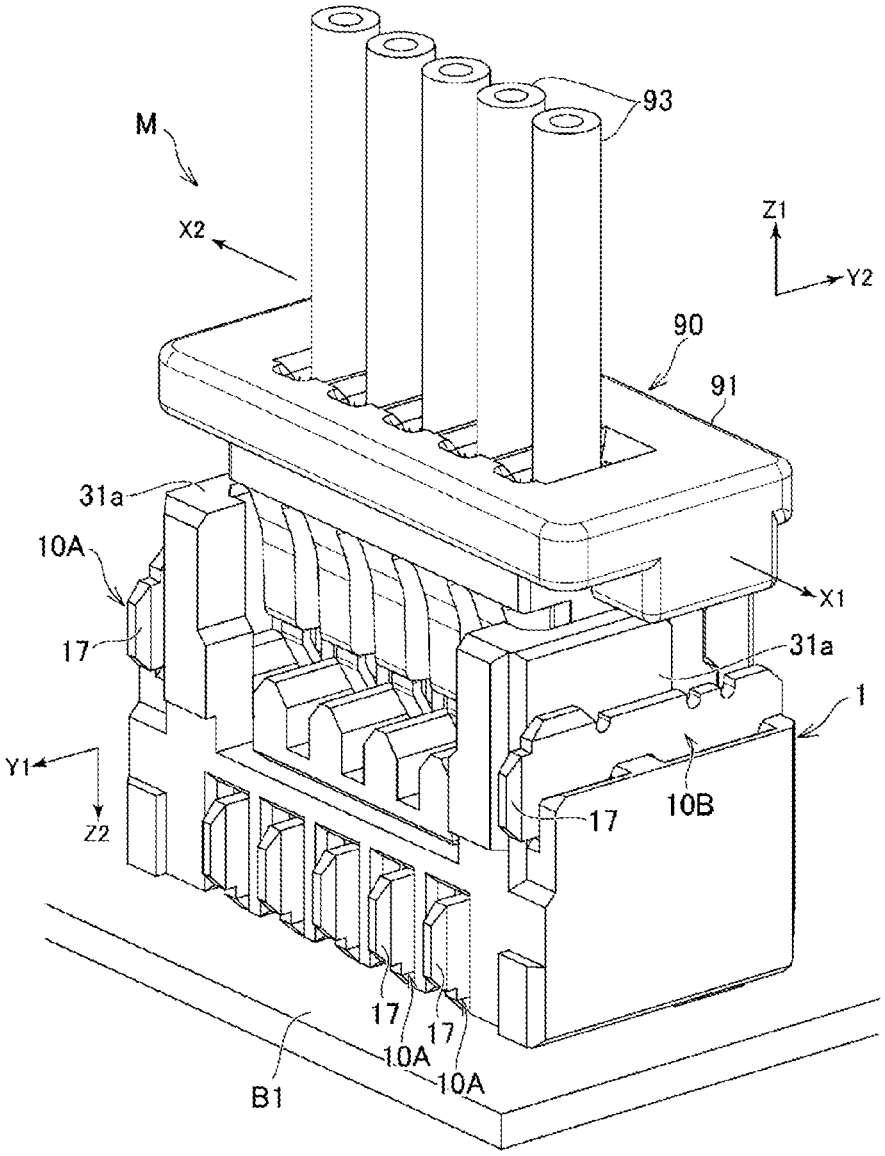
FIG. 1 is a perspective view of a connector assembly having a connector (first connector) proposed in the present disclosure.

The connector proposed in the present disclosure will be described with reference to FIG. 1 to FIG. 11B. These diagrams illustrate, as examples of the connector proposed in the present disclosure, a first connector 1, and a connector assembly M including a first connector 1 and a second connector 90. Below, the Z1, Z2, Y1, Y2, X1, and X2 directions as illustrated in FIG. 1 and elsewhere are used to illustrate the relative positioning of each part of the connector and do not limit the orientation of the connector mounted on the circuit board. The Z-axis direction, the Y-axis direction, and the X-axis direction are directions orthogonal to each other. The Z1 direction is one of two directions along the Z-axis direction, and the Z2 direction is the direction opposite the Z1 direction. Similarly, the Y1 direction is one of two directions along the Y-axis direction, and the Y2 direction is the direction opposite the Y1 direction. The X1 direction is one of the two directions along the X-axis direction, and the X2 direction is the direction opposite the X1 direction.

As described below, a first connector 1 can be mounted on a circuit board B1 (see FIG. 1) which is arranged in the Z2 direction with respect to the first connector 1, or mounted on a circuit board B2 (see FIG. 3), which is arranged in the Y1 direction with respect to the first connector 1. Regardless of the orientation of the first connector 1, that is to say, regardless of whether the first connector 1 is in the vertical orientation (see FIG. 1) or in a horizontal orientation (see FIG. 3), as described below, the direction in which the first connector 1 and the second connector 90 are connected is the Z-axis direction, and the direction in which the second connector 90 is positioned with respect to the first connector 1 is the Z1 direction.

As illustrated in FIG. 1, a connector assembly M has a first connector 1 and a second connector 90. The first connector 1 is a connector mounted on a circuit board, and the second connector 90 is a mating connector provided at the end of a cable 93.

Figure 2:
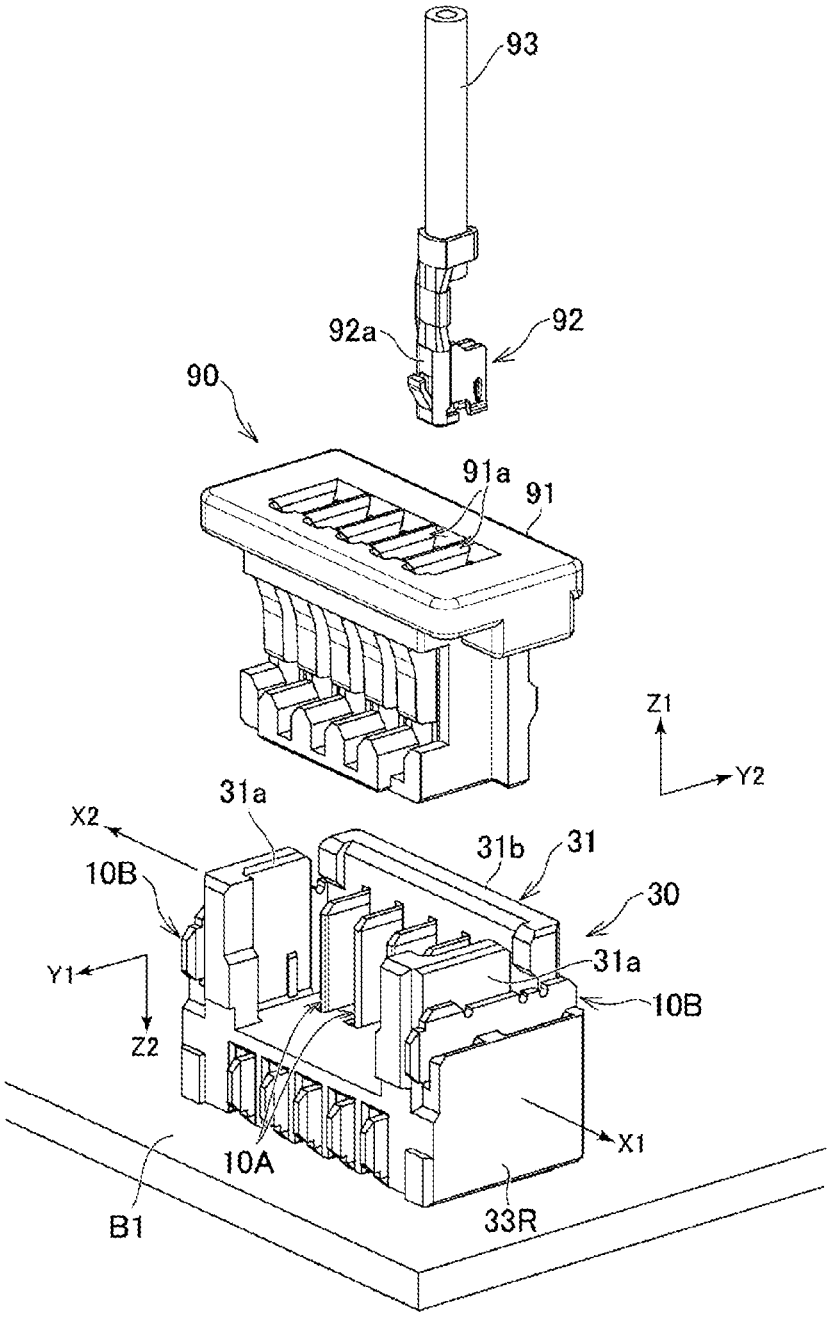
FIG. 2 is an exploded perspective view of the connector assembly illustrated in FIG. 1. The figure illustrates that the first connector that makes up the connector assembly is mounted on a circuit board in a vertical orientation.

As illustrated in FIG. 2, the cable 93 may have terminals 92 at an end thereof. The second connector 90 includes a housing 91. The housing 91 has a plurality of terminal retaining holes 91*a* into which terminals 92 are inserted and which retain the terminals 92. The plurality of terminal retaining holes 91*a* are lined up in the X-axis direction. Each terminal retaining holes 91*a* is open in the Z1 direction.

Figure 9:
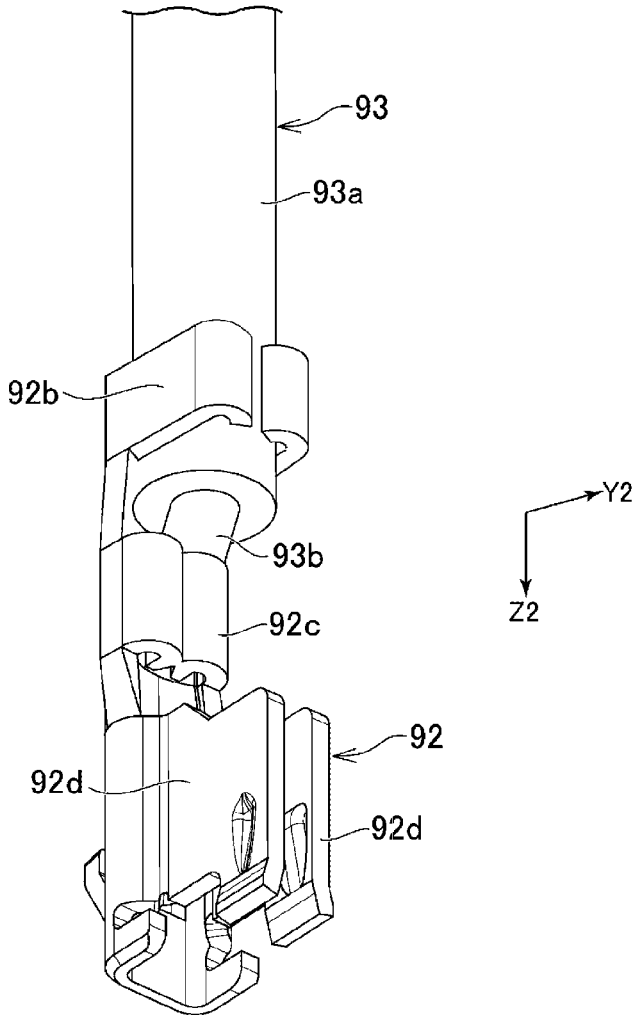
FIG. 9 is a perspective view of the mating terminal (cable terminal).

As illustrated in FIG. 2 and FIG. 9, the cable terminal 92 includes a main plate part 92*a* that extends in the Y2 direction from the vicinity of the end part of the cable 93. The base part of the main plate part 92*a* includes a cable retaining part 92*b* that retains the outer covering 93*a* of the cable 93. Furthermore, the main plate part 92*a* includes a crimped part 92*c* that retains the core wire 93*b* of the cable 93. The cable terminal 92 has two contact parts 92*d* that face each other at an end part thereof. The two contact parts 92*d* are bent at the edge of the main plate part 92*a* and face each other in the X-axis direction.

Figure 3:
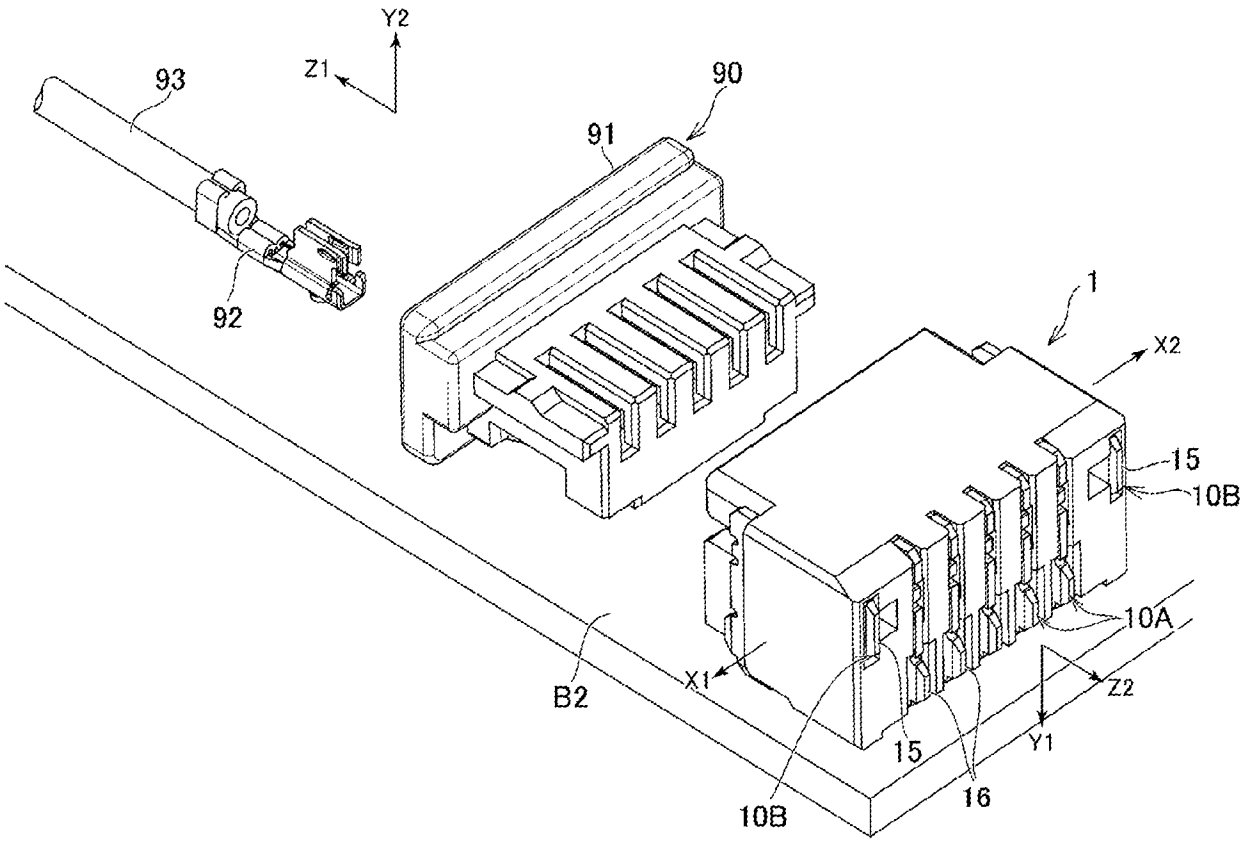
FIG. 3 is a perspective view illustrating the first connector mounted on a circuit board in a horizontal orientation.

The first connector 1 can be mounted on a circuit board in both a vertical orientation as illustrated in FIG. 1 and a horizontal orientation as illustrated in FIG. 3. When the first connector 1 is in a vertical orientation as illustrated in FIG. 1, the first connector 1 and the second connector 90 connect in a direction perpendicular to the circuit board B1. When the first connector 1 is in a vertical orientation, the second connector 90 may be connected to the first connector 1 in a direction inclined with respect to a direction perpendicular to the circuit board B1. When the first connector 1 is in a horizontal orientation as illustrated in FIG. 3, the first connector 1 and the second connector 90 connect in a direction parallel to the plane of the circuit board B2. When the first connector 1 is in a horizontal orientation, the second connector 90 may be connected to the first connector 1 in a direction inclined with respect to a direction parallel to the plane of the circuit board B.

Furthermore, the second connector 90 need not necessarily be a connector provided at the end of the cable 93. The second connector may be a connector mounted to a circuit board. The circuit board on which the second connector is provided and the circuit board B1 (or B2) on which the first connector 1 is mounted may be connected to each other via these two connectors.

Figure 4:
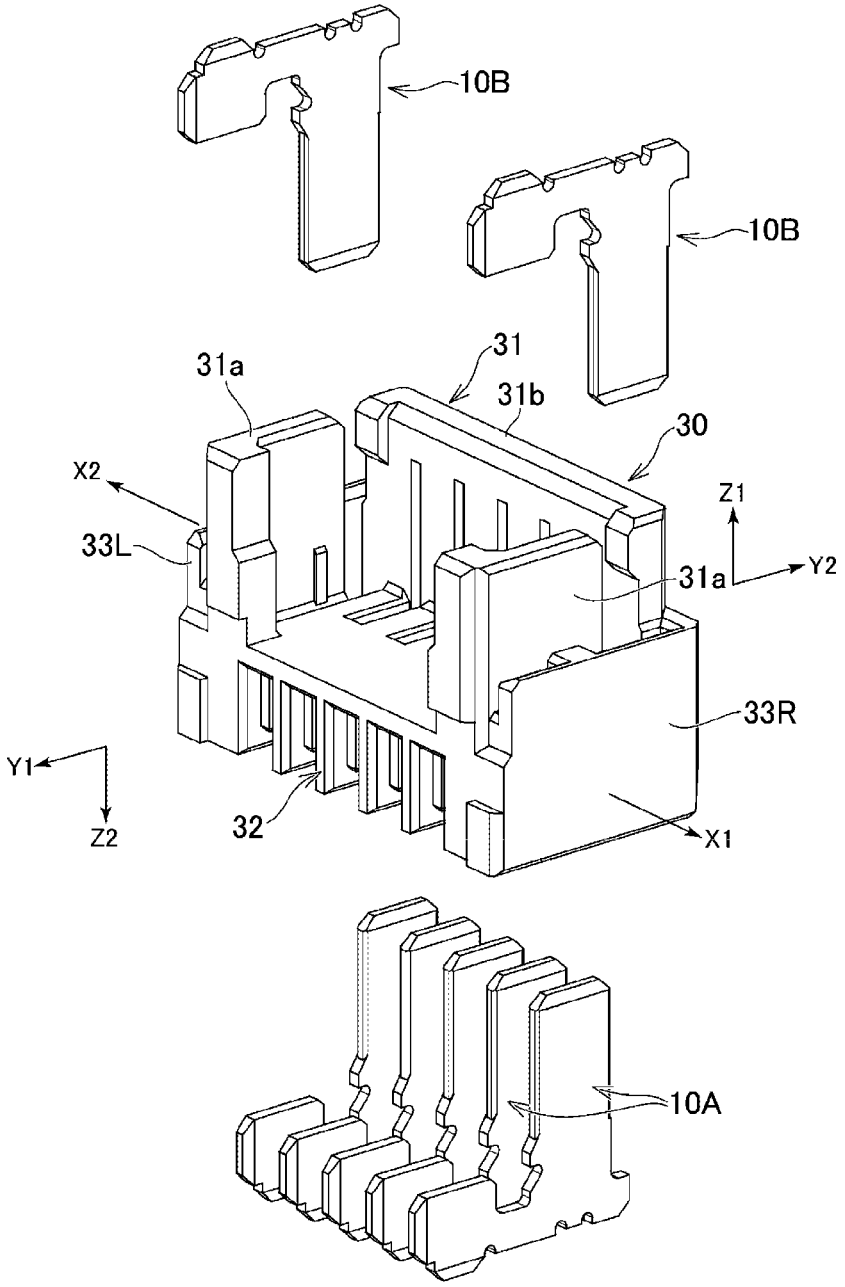
FIG. 4 is an exploded perspective view of the first connector.

As illustrated in FIG. 4, the first connector 1 may include a plurality of first metal members 10A, a plurality of second metal members 10B, and a housing 30 that retains the metal members 10A, 10B. The first metal members 10A function as terminals that establish an electrical connection with a mating terminal (cable terminal 92 in the example of the connector assembly 10). The plurality of first metal members 10A are lined up in the X-axis direction. The second metal members 10B function as reinforcing brackets for increasing the securing strength between the first connector 1 and the circuit boards B1, B2. One of the two second metal members 10B is arranged in the X1 direction with respect to the plurality of first metal members 10A, and the other is arranged in the X2 direction with respect to the plurality of first metal members 10A. The metal members 10A, 10B may be formed by press forming from a metal plate such as phosphor bronze or brass, for example, but the forming method is not limited thereto. The material of the first metal member 10A and the material of the second metal member 10B are preferably the same but are not necessarily limited thereto.

As illustrated in FIG. 4, the housing 30 may include a mating wall 31 in which the second connector 90 fits inside, and a base part 32 positioned at the bottom of the mating wall 31. The mating wall 31 includes side walls 31*a* , 31*a* that are erected in the Z1 direction from the base part 32 and face each other in the X-axis direction, and a rear wall 31*b* (wall part having an outer surface facing in the Y2 direction) extending in the X-axis direction. The side walls 31*a* , 31*a* , which are positioned opposite each other in the X-axis direction, and the rear wall 31*b* , surround three sides of the second connector 90. When the first connector 1 and the second connector 90 are mated, the rear wall 31*b* is arranged along the surface of the second connector 90 facing in the Y2 direction. The mating wall 31 may be open in the Y1 direction as well as in the Z1 direction. Alternatively, the mating wall 31 may only open in the Z1 direction and encompass the four directions of the second connector 90.

Figure 8A:
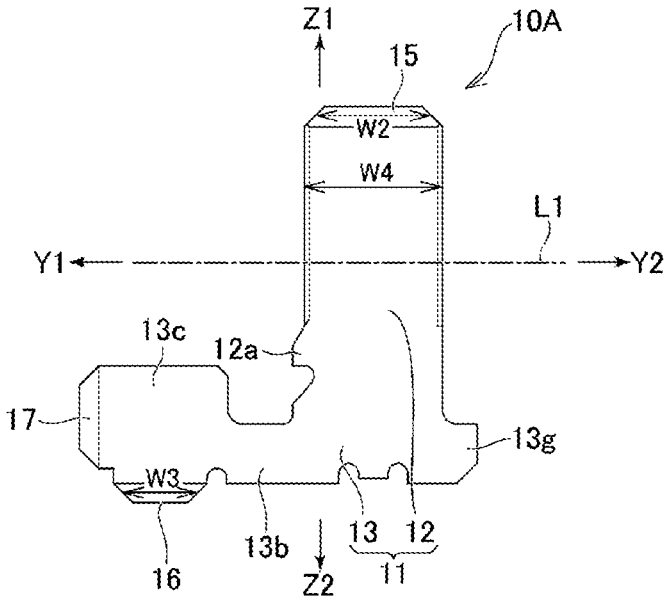
FIG. 8A is a side view of the first metal member (terminal)
Figure 8B:
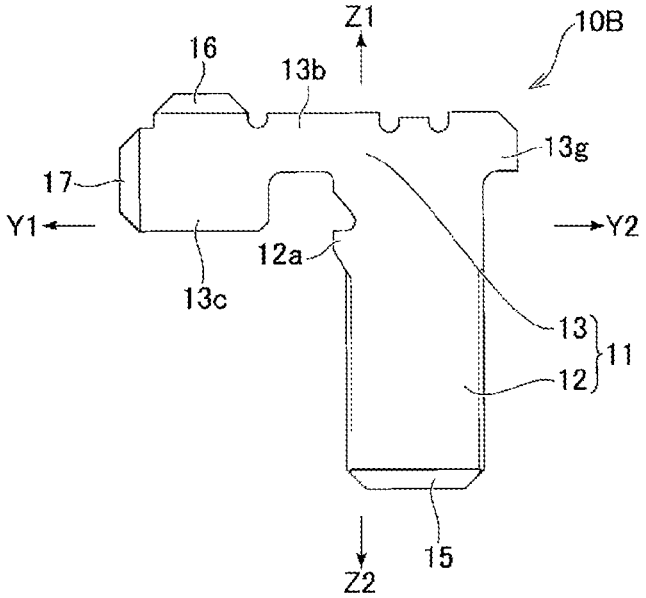
FIG. 8B is a side view of the second metal member (reinforcing bracket).

As illustrated in FIG. 8A and FIG. 8B, each of the first metal members 10A and second metal members 10B may include a main body part 11, a first edge part 15, a second edge part 16, and a third edge part 17. The main body part 11 may include a first extending part 12 and a second extending part 13 that extends in a direction intersecting the first extending part 12.

Figure 6A:
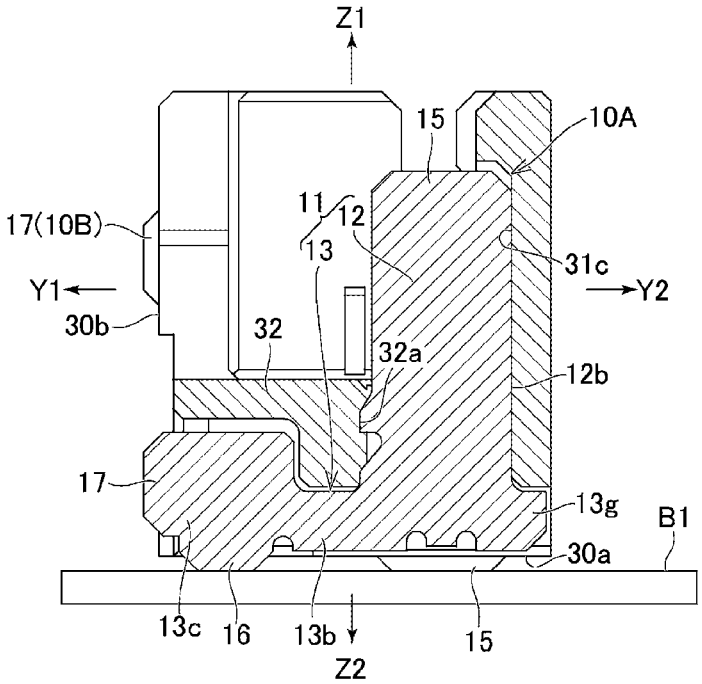
FIG. 6A is a cross-sectional view obtained on the line VIa-VIa as illustrated in FIG. 5. The diagram illustrates the first connector in a vertical orientation.

As illustrated in FIG. 6A, the main body part 11 of the first metal member 10A may include a first extending part 12 extending in the Z-axis direction and a second extending part 13 connected to the first extending part 12 and extending in the Y-axis direction. The first extending part 12 is connected to a portion of the second extending part 13 offset in the Y2 direction from the center thereof in the Y-axis direction, and the first metal member 10A may have an overall substantial L-shape. The second extending part 13 may have a protruding part 13g that protrudes further in the Y2 direction than the first extending part 12. As described below, the first edge part 15 is formed at an end part of the first extending part 12, or in other words, the first edge part 15 is formed at an end part in a direction opposite to the connection between the first extending part 12 and the second extending part 13. The second edge part 16 and the third edge part 17 are formed on the second extending part 13.

Figure 5:
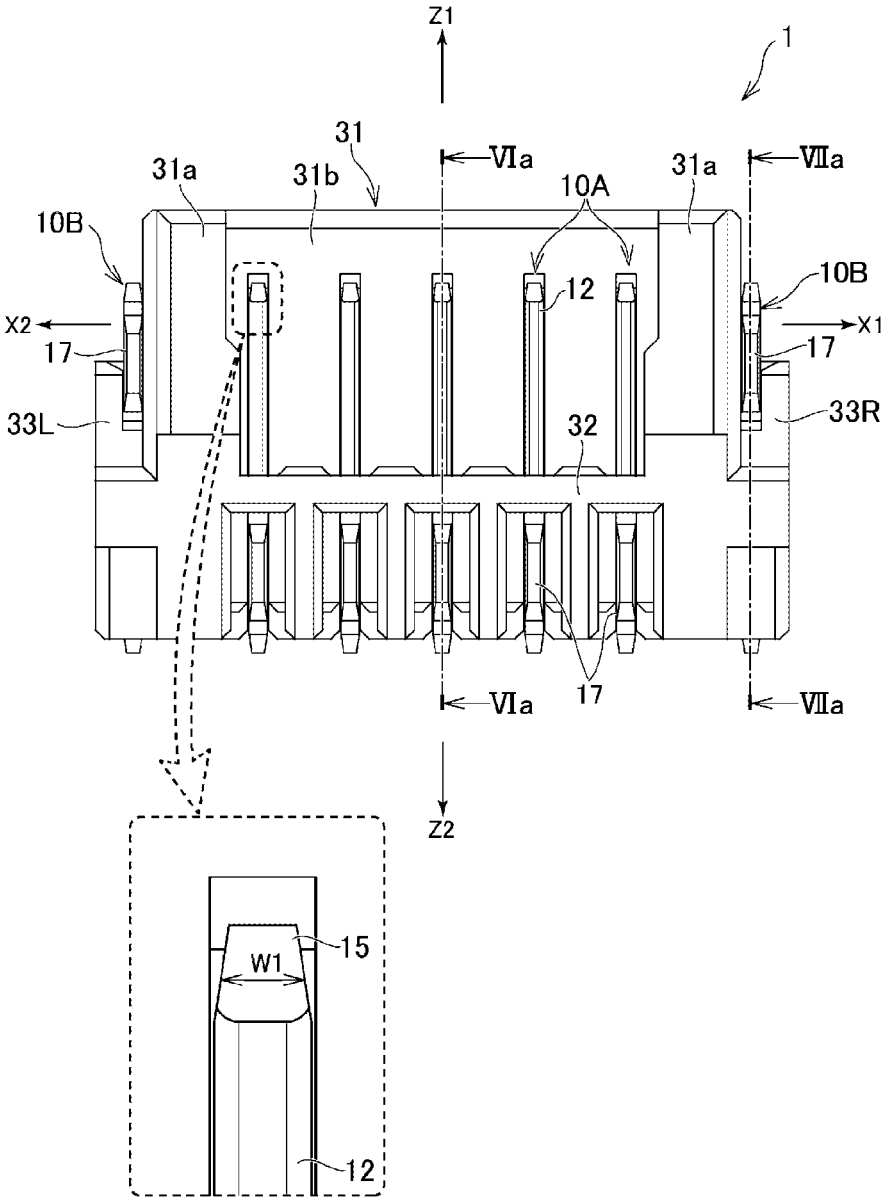
FIG. 5 is a front view of the first connector.

As illustrated in FIG. 5 and FIG. 6A, the main body part 11 of the first metal member 10A is exposed at least partially inside the mating wall 31 and can come into contact with the mating terminals or, in other words, cable terminal 92. The main body part 11 (more specifically, the first extending part 12) of the first metal member 10A is inserted between and contacts two contact plates 92*a*.

As illustrated in FIG. 8A, the first edge part 15 of the first metal member 10A is positioned more in the Z1 direction than the main body part 11. In the example of the first connector 1, the first extending part 12 extends in the Z1 direction from the portion of the first connector 1 near the end part in the Z2 direction. The first edge part 15 is formed at an end part of the first extending part 12 in the Z1 direction. As illustrated in FIG. 5, the width W1 of the first edge part 15 in the X-axis direction may gradually decrease toward the extension direction of the first extending part 12.

As illustrated in FIG. 8A, the second edge part 16 of the first metal member 10A is positioned more in the Z2 direction than the main body part 11. As illustrated in FIG. 6A, the second edge part 16 protrudes beyond the outer surface (lower surface 30*a* ) of the housing 30 facing in the Z2 direction and can be connected to the circuit board B1 arranged in the Z2 direction with respect to the first connector 1. In other words, the second edge part 16 can be soldered to a conductor pad (not shown) formed on the circuit board B1. In the example of the first metal member 10A, the second edge part 16 is part of the edge of the second extending part 13 in the Z2 direction. The second edge part 16 is positioned further in the Y1 direction than the second extending part 13 from the center in the Y-axis direction and protrudes in the Z2 direction from the rear surface of the housing 30. The position of the second edge part 16 is not limited to the example of the first connector 1. The second edge part 16 may be positioned more in the Y2 direction relative to the center of the second extending part 13 in the Y-axis direction.

In the example of the first metal member 10A, the second extending part 13 includes a coupling part 13*b* that is adjacent to the part connecting with the first extending part 12, and a front part 13*c* that is positioned in the Y1 direction with respect to the coupling part 13*b* and has a width greater than that of the connecting part 13*b* in the Z-axis direction.

The third edge part 17 of the first metal member 10A is positioned more in the Y1 direction than the main body part 11 (see FIG. 1). As illustrated in FIG. 6A, the third edge part 17 protrudes from an outer surface (front surface 30*b*) of the housing 30 oriented in the Y1 direction and can be connected with the circuit board B2 (see FIG. 3) arranged in the Y1 direction with respect to the first connector 1. In other words, the third edge part 17 can be soldered to a conductor pad (not shown) formed on the circuit board B2. In the example of the first metal member 10A, the third edge part 17 is the Y1 direction edge of the second extending part 13.

In the example of the first metal member 10A, the third edge part 17 is the leading edge (Y1 direction edge) of the front part 13*c* of the second extending part 13, and the second edge part 16 is the lower edge of the front part 13*c* (edge in the Z2 direction). Thus, the second edge part 16 and the third edge part 17 are adjacent to each other with a corner formed from two edges of the front part 13*c*.

As illustrated in FIG. 8A and FIG. 8B, the relative positions of the main body part 11, the first edge part 15, the second edge part 16, and the third edge part 17 in the second metal member 10B may be substantially similar to their relative positions as in the first metal member 10A. The relative positions of the main body part 11, the first edge part 15, the second edge part 16, and the third edge part 17 refer to, with regards to the side view of metal members 10A, 10B, for example, a direction in which the first edge part 15 is positioned with respect to the main body part 11, a direction in which the second edge part 16 is positioned with respect to the main body part 11, a direction in which the third edge part 17 is positioned with respect to the main body part 11, and the distances thereof. The relative positions of each part of the first metal member 10A and the relative positions of each part of the second metal member 10B need not necessarily be completely the same as long as the manufacturing steps and manufacturing components (molds, for example) of the metal members 10A, 10B can be shared.

As illustrated in FIG. 8A and FIG. 8B, the first metal member 10A and the second metal member 10B preferably have substantially the same shape. In other words, the relative positions of each part of the first metal member 10A and the relative positions of each part of the second metal member 10B are substantially the same, and in addition, the shapes and sizes of the each part of the first metal member 10A and the second metal member 10B may also be substantially the same.

The thickness of the first metal member 10A and the thickness of the second metal member 10B may also be the same. In this case, the first metal member 10A should be able to be inserted into the retaining hole 33*a* into which the second metal member 10B is inserted, and the second metal member 10B should be able to be inserted into the retaining hole 32*a* into which the first metal member 10A is inserted.

The shape of the first metal member 10A and the shape of the second metal member 10B need not necessarily be completely the same as long as the manufacturing steps and manufacturing components (molds, for example) of the metal members 10A, 10B can be shared. The thickness of the first metal member 10A and the thickness of the second metal member 10B need not necessarily be the same.

Regarding the metal members 10A, 10B, one or more of the main body part 11, the first edge part 15, the second edge part 16, and the third edge part 17 may be the same shape. For example, although the metal members 10A and 10B have the same shape in portions other than the first edge part 15, the shape of the first edge part 15 of the first metal member 10A and the shape of the first edge part 15 of the second metal member 10B may be different. For example, while the width W1 of the first edge part 15 of the first metal member 10A may gradually decrease approaching the tip (end in the Z1 direction), the width of the first edge part 15 of the second metal member 10B may be constant.

The second metal member 10B is retained by the housing 30 in a different orientation than that of the first metal member 10A. For example, the second metal member 10B is retained by the housing 30 in an orientation in which the first metal member 10A is inverted with respect to a straight line L1 (see FIG. 8A) along the Y-axis direction. Unlike the example of the first connector 1, the second metal member 10B may be retained in an orientation in which the first metal member 10A is rotated centered around a straight line along the X-axis direction. For example, the second metal member 10B may be retained in an orientation in which the first metal member 10A is rotated 90 degrees centered around a straight line along the X-axis direction.

Figure 7A:
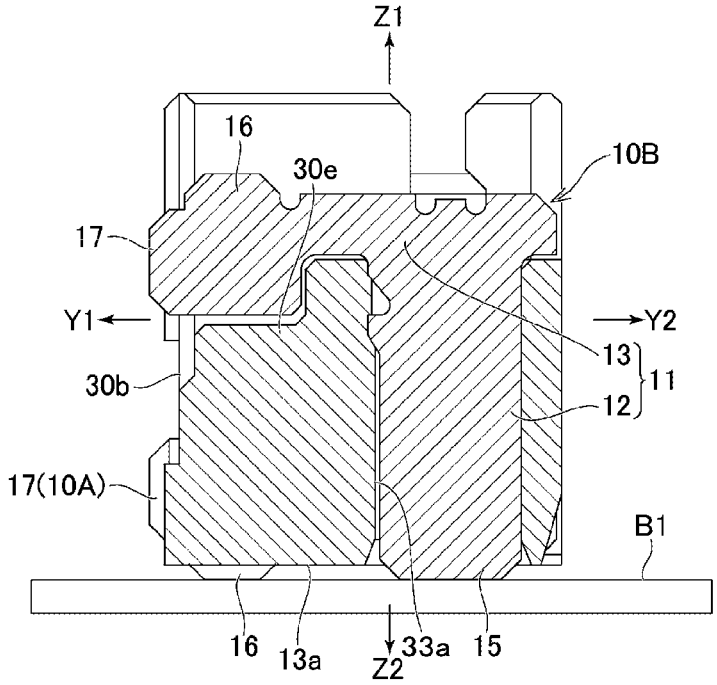
FIG. 7A is a cross-sectional view obtained on the line VIIa-VIIa as illustrated in FIG. 5. The diagram illustrates the first connector in a vertical orientation.

As described above, the second metal member 10B is a member that functions as a reinforcing bracket for securing the first connector 1 to the circuit board. As illustrated in FIG. 8B, the first edge part 15 of the second metal member 10B is positioned more in the Z2 direction than the main body part 11. As illustrated in FIG. 7A, the first edge part 15 protrudes in the Z2 direction from the lower surface 30*a* of the housing 30 (the surface facing in the Z2 direction) and can be attached to the circuit board B1 arranged in the Z2 direction of the first connector 1. In other words, the first edge part 15 can be soldered to a pad formed on the circuit board B1.

Thus, the first edge part 15, which is the tip of the main body part 11 that includes a portion that functions as a contact part with the other terminal in the first metal member 10A, is used as a portion that is attached to the circuit board B1 in the second metal member 10B. Furthermore, the first metal member 10A and the second metal member 10B have common portions (specifically, the main body part 11, the second edge part 16, and the third edge part 17). Therefore, a metal member having substantially the same shape as the first metal member 10A can be used as the second metal member 10B. And as such, the manufacturing steps or manufacturing components (molds, for example) of the second metal member 10B can be shared with the first metal member 10A, and cost of the connector can be further reduced. Note that the second metal member 10B may be retained in an orientation in which the first metal member 10A is rotated 90 degrees centered around a straight line along the X-axis direction. With this structure, the first metal member 10A that functions as a terminal and the second metal member 10B that functions as a reinforcing bracket can be made substantially the same, such that cost of the connector can be further reduced.

The first edge part 15 of the second metal member 10B is formed at an end part of the first extending part 12 in the extending direction (Z2 direction). The width of the first edge part 15 of the second metal member 10B may gradually decrease toward the Z2 direction, similar to the width of the first edge part 15 of the first metal member 10A. In particular, the width of the first edge part 15 of the second metal member 10B in the X-axis direction may gradually decrease toward the Z2 direction, similar to the width W1 of the first edge part 15 of the first metal member 10A (see FIG. 5). In addition, the width of the first edge part 15 of the second metal member 10B in the Y-axis direction may gradually decrease toward the Z2 direction, similar to the width W2 of the first edge part 15 of the first metal member 10A (see FIG. 8A). Unlike the example of the first connector 1, the first edge part 15 of the first metal member 10A gradually decreases in the Z2 direction, while the width of the first edge part 15 of the second metal member 10B may be constant.

As illustrated in FIG. 7A, in the example of the first connector 1, the first edge part 15 of the second metal member 10B is positioned to the rear of the first connector 1 (the portion positioned more in the Y2 direction relative to the center in the Y-axis direction). The second metal member 10B does not have a portion at the front of the first connector 1 (the portion positioned more in the Y1 direction relative to the center in the Y-axis direction) arranged in the Z2 direction with respect to the first connector 1 that can be attached to the circuit board B1.

As illustrated in FIG. 6A and FIG. 7A, the second edge part 16 of the first metal member 10A and the first edge part 15 of the second metal member 10B are separated in the Y-axis direction (when the first connector 1 is viewed along the X-axis direction) in a side view of the first connector 1. This structure effectively prevents the end part of the first connector 1 in the Y1 direction or the end part of the first connector 1 in the Y2 direction from separating from the circuit board B1 when the cable 93 is pulled in an oblique direction against the circuit board B1 while the first connector 1 is mounted on the circuit board B1. In particular, when pulled in an oblique direction between the Y1 and Z1 directions in FIG. 6A, the end part of the first connector 1 in the Y2 direction can effectively prevent separation from the circuit board B1. Also, when the cable 93 is pulled in an oblique direction between the Y2 and Z1 directions while the first connector 1 is mounted on the circuit board B1, separation of the end part of the first connector 1 in the Y1 direction from the circuit board B1 can be effectively prevented.

As illustrated in FIG. 6A, in the example of the first connector 1, the second edge part 16 of the first metal member 10A and the first edge part 15 of the second metal member 10B are separated in the Y-axis direction and do not have overlapping portions in a side view of the first connector 1 (when viewing the first connector 1 in the X-axis direction), and a gap is ensured therebetween. In this manner, the second edge part 16 of the first metal member 10A and the first edge part 15 of the second metal member 10B are positioned near the end part of the first connector 1 in the Y-axis direction, and as such, even when a force in the diagonal direction acts on the first connector 1, the first connector 1 can be further prevented from separating from the circuit board. On the other hand, when the widths W2, W3 (see FIG. 8A) of the second edge part 16 of the first metal member 10A and the first edge part 15 of the second metal member 10B are set large, the second edge part 16 of the first metal member 10A and the first edge part 15 of the second metal member 10B may partially overlap.

As illustrated in FIG. 8A and FIG. 8B, in each of the metal members 10A, 10B, the size (width W2) of the first edge part 15 in the Y-axis direction of the first connector 1 may be larger than the size of the second edge part 16 in the same direction (width W3). In this way, when the first connector 1 is mounted to the circuit board B1 in a vertical orientation, the width (W2) of the first edge part 15 of the second metal member 10B is greater than the width (W3) of the second edge part 16 of the first metal member 10A.

The first extending part 12 having the first edge part 15 at the end part thereof also has a relatively large width W4 in the Y-axis direction. The contact part 92*d* of the cable terminal 92 of the second connector 90 forms a substantially U-shaped shape together with the main plate part 92*a* . In other words, the contact part 92*d* is open in a direction orthogonal to the connecting direction (Z-axis direction) of the connectors 1, 90, and specifically, in the Y2 direction. As the contact part 92*d* is open in this manner, the width of the first extending part 12 (in other words, the width of the first edge part 15) can be increased.

Figure 7B:
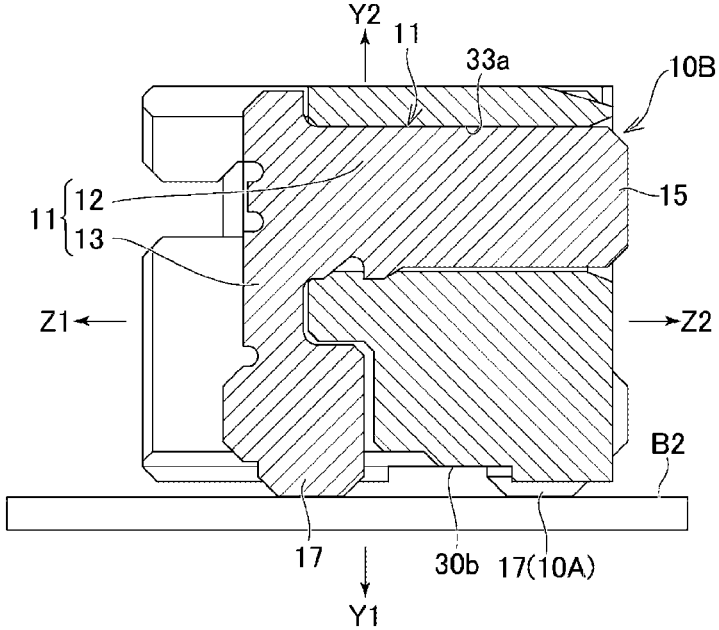
FIG. 7B is a cross-sectional view of the first connector in a horizontal orientation. The position of this cross-section is the same as in FIG. 7A.

Further, as illustrated in FIG. 8B, the third edge part 17 of the second metal member 10B is positioned in the Y1 direction from the main body part 11. As illustrated in FIG. 7B, the third edge part 17 protrudes in the Y1 direction from a front surface 30*b* (the surface facing in the Y1 direction) of the housing 30 and can be attached to a circuit board B2 arranged in the Y1 direction with respect to the first connector 1. That is, the third edge part 17 can be soldered to a pad formed on the circuit board B2.

In the example of the first connector 1, the third edge part 17 of the second metal member 10B is positioned on the upper portion (portion near the end in the Z1 direction) of the first connector 1, as illustrated in FIG. 7A. The second metal member 10B does not have a portion that can be attached to the circuit board B2 on the lower portion of the first connector 1 (the portion near the end in the Z2 direction). As illustrated in FIG. 6A and FIG. 7A, the third edge part 17 of the first metal member 10A and the third edge part 17 of the second metal member 10B are separated in the Z-axis direction in a side view of the first connector 1.

Figure 6B:
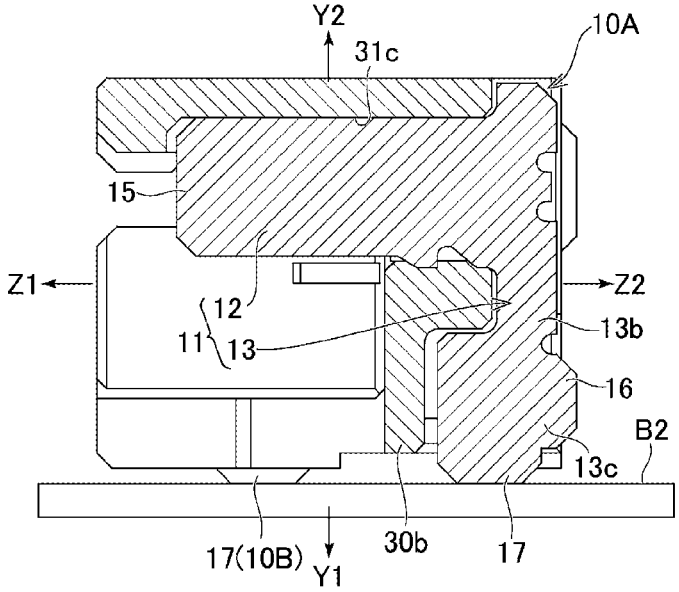
FIG. 6B is a cross-sectional view of the first connector in a horizontal orientation. The position of this cross-section is the same as in FIG. 6A.

This structure can prevent the end part of the first connector 1 in the Z1 direction from separating from the circuit board B2 when the cable 93 is pulled in an oblique direction to the first connector 1 mounted on the circuit board B2, or in other words, when the cable 93 is pulled in an oblique direction between Y2 and Z2 directions, as illustrated in FIG. 6B and FIG. 7B. In the example of the first connector 1, the third edge part 17 of the first metal member 10A and the third edge part 17 of the second metal member 10B do not have portions overlapping in the side view (X-axis direction) of the first connector 1, and a gap is ensured therebetween. As described above, the third edge part 17 of the first metal member 10A and the third edge part 17 of the second metal member 10B are respectively positioned near the ends of the first connector 1 in the Z1 direction and in the Z2 direction. Therefore, even when an oblique force is applied to the first connector 1, the first connector 1 is further prevented from separating from the circuit board. On the other hand, if the respective widths of the third edge part 17 of the first metal member 10A and the third edge part 17 of the second metal member 10B are set large, they may partially overlap.

As illustrated in FIG. 6A, the base part 32 of the housing 30 has a plurality of retaining holes 32*a* into which the first metal members 10A, which are terminals, are respectively inserted. The retaining hole 32*a* is open in the Z2 direction, and the first metal member 10A is inserted into the retaining hole 32*a* in the Z1 direction. The first metal member 10A includes a hooking part 12*a* (see FIG. 8A) at an edge of the first extending part 12 in the Y1 direction. The hooking part 12*a* is engaged with the inner surface of the retaining hole 32*a* (see FIG. 6A). This restricts the first metal member 10A from falling out of the retaining hole 32*a* . The position of the hooking part 12*a* is not limited to the example of the first connector 1. The hooking part 12*a* may be formed on an edge of the first extending part 12 in the Y1 direction and an edge in the Y2 direction, or may be formed only on the edge of the first extending part 12 in the Y2 direction.

A groove 31*c* that is continuous from the retaining hole 32*a* is formed in the rear wall 31*b* (wall portion having an outer surface facing in the Y2 direction) of the mating wall 31 of the housing 30. A portion of the first extending part 12 (edge 12*b* in the Y2 direction) may be housed in the groove 31*c* . This configuration can prevent the second connector 90 from colliding with the first extending part 12 and bending of the first extending part 12 when the second connector 90 and the first connector 1 are joined.

As illustrated in FIG. 5, a plurality of retaining holes 33*a* (see FIG. 7A) are formed in the right part 33R (near the end in the X1 direction) and the left part 33 L (near the end in the X2 direction) of the mating wall 31 of the housing 30 and the second metal members 10B, which are reinforcing brackets, are inserted thereinto. The retaining hole 33*a* is open in the Z1 direction, and the second metal member 10B is inserted into the retaining hole 33*a* in the Z2 direction. The second metal member 10B includes a hooking part 12*a* (see FIG. 8B) on an edge of the first extending part 12. The hooking part 12*a* is engaged with the inner surface of the retaining hole 33*a* (see FIG. 7A). This restricts the first metal member 10A from falling out of the retaining hole 33*a* . The first extending part 12 of the second metal member 10B differs from the first extending part 12 of the first metal member 10A, such that a majority of the first extending part 12 is housed in the retaining hole 33*a*.

As described above, the second metal member 10B is inserted into the retaining hole 33*a* formed in the housing 30 in a direction different from that of the first metal member 10A. Specifically, the first metal member 10A is inserted in the Z1 direction with respect to the retaining hole 32*a* of the housing 30, and the second metal member 10B is inserted in the Z2 direction with respect to the retaining hole 33*a* of the housing 30. The base part 32 (first stopper part) of the housing 30 is positioned in the Z1 direction with respect to the second extending part 13 of the first metal member 10A and restricts movement of the first metal member 10A in the Z1 direction. The housing 30 includes a second stopper part 30*e* that is positioned in the Z2 direction with respect to the second extending part 13 of the second metal member 10B and restricts movement of the second metal member 10B in the Z2 direction. In this manner, the base part 32 and the second stopper part 30*e* of the housing 30 are sandwiched in the Z-axis direction by the first metal member 10A and the second metal member 10B. When the cable 93 is pulled while the second connector 90 and the first connector 1 are connected, the second metal fittings 10*b* secured to the circuit boards B1, B2 can prevent the housing 30 from detaching in the Z1 direction from the first metal member 10*a* fixed to the circuit boards B1, B2. Furthermore, when the second connector 90 is disconnected from the first connector 1, a force to release the first connector 1 from the circuit boards B1, B2 acts on the first connector due to the friction between the cable terminal 92 and the first metal members 10A. At this time, the first connector 1 can be prevented from being detached from the circuit boards B1, B2 by the second metal fittings 10B [sic] that are secured to the circuit boards B1, B2.

Note that the insertion direction of the second metal member 10B is not limited to the example of the first connector 1. For example, a retaining hole for the second metal member 10B may open in the Y2 direction, and the second metal member 10B may be inserted in the Y1 direction with respect to the retaining hole. Conversely, a retaining hole for the second metal member 10B may open in the Y1 direction, and the second metal member 10B may be inserted into the retaining hole in the Y2 direction. In yet other examples, the metal members 10A, 10B may be integrally formed with the housing 30. In other words, the metal members 10A, 10B may be formed together with the housing 30 using insert molding. Insert molding is a method of injecting molten resin into a mold into which the metal members 10A, 10B are inserted, integrating the metal members 10A, 10B and resin (housing 30).

As described above, the first connector 1 is a connector that includes first metal members 10A that function as terminals, second metal members 10B that function as reinforcing brackets, and a housing 30 that retains the first metal members 10A and the second metal members 10B, and connects with a mating connector in the Z-axis direction. Each first metal member 10A and second metal member 10B include a main body part 11, a first edge part 15, a second edge part 16, and a third edge part 17. The main body part 11 of the first metal member 10A includes a portion where a mating terminal (cable terminal 92) contacts. The first edge part 15 of the first metal member 10A is positioned more in the Z1 direction than the main body part 11. The second edge part 16 of the first metal member 10A is positioned more in the Z2 direction than the main body part 11 and can be connected to the first circuit board B1 arranged in the Z2 direction with respect to the first connector 1. The third edge part 17 of the first metal member 10A is positioned more in the Y1 direction than the main body part 11 and can be connected to the second circuit board B2 arranged in the Y1 direction with respect to the first connector 1. The second metal member 10B is retained in a different orientation from the first metal member 10A. The first edge part 15 of the second metal member 10B is positioned more in the Z2 direction than the main body part 11 of the second metal member 10B and can be attached to the first circuit board B1 arranged in the Z2 direction with respect to the first connector 1. The third edge part 17 of the second metal member 10B is positioned more in the Y1 direction than the main body part 11 of the second metal member 10B and can be attached to the second circuit board B2 arranged in the Y1 direction with respect to the first connector 1. The second edge part 16 of the second metal member 10B is positioned more in the Z1 direction than the main body part 11 of the second metal member 10B. With this first connector 1, the first metal member 10A, which functions as a terminal, and the second metal member 10B, which functions as a reinforcing bracket, can be made substantially the same shape, thereby enabling further cost reduction.

In addition, with the first connector 1, the metal members 10A, 10B have a substantially L-shaped shape. The shape of the metal members is not limited to this. For example, the metal members 10A, 10B may have a substantially T-shaped shape.

Figure 10A:
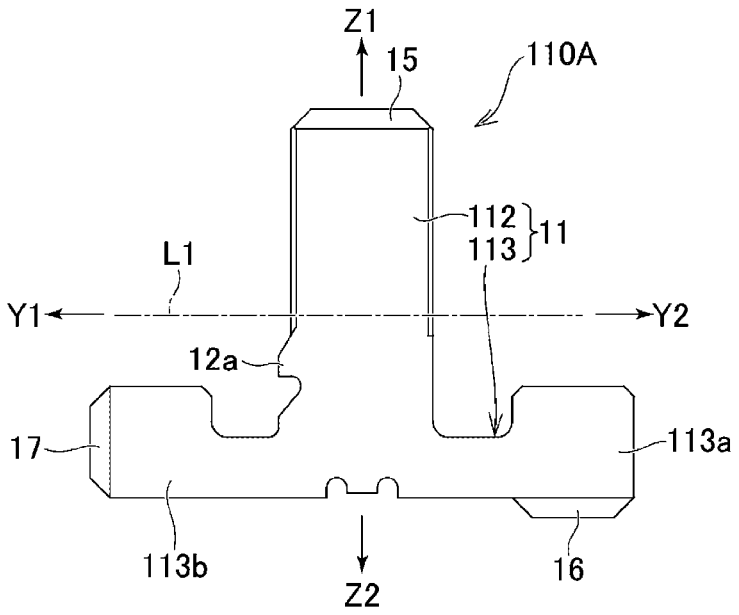
FIG. 10A is a side view illustrating a modified example of the first metal member.
Figure 10B:
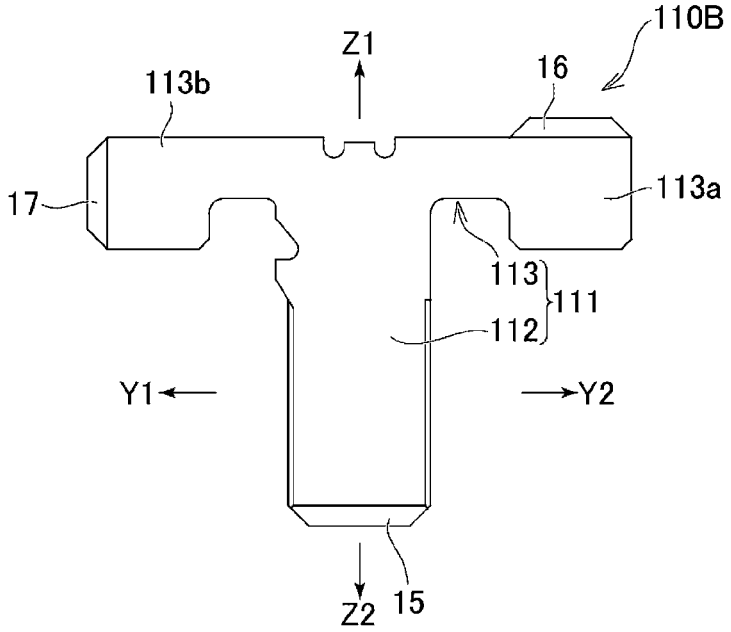
FIG. 10B is a side view illustrating a modified example of the second metal member.

FIG. 10A and FIG. 10B illustrate metal members 110A and 110B, having a substantially T-shaped shape. The first metal member 110A is a terminal that connects with a cable terminal, and the second metal member 110B is a reinforcing bracket for securing the first connector 1 to a circuit board.

A main body part 111 of the first metal member 110A includes a first extending part 112 that extends in the Z-axis direction and a second extending part 113 connected to the first extending part 112 and extending in the Y-axis direction. The first extending part 112 is connected to a central portion of the second extending part 113, and the first metal member 110A has, overall, a substantially T-shaped shape. The second extending part 113 may have a rear part 113*a* that extends more in the Y2 direction than the first extending part 112, and a front part 113*b* that is a portion that extends more in the Yl direction than the first extending part 112.

The first edge part 15 is formed at the Z1 direction end part of the first extending part 112. The second edge part 16 is formed on the Z2 direction edge of the rear part 113*a* of the second extending part 113 and is positioned more in the Z2 direction of the first connector than the main body part 111. The second edge part 16 protrudes from a lower surface 30*a* of the housing 30 (surface facing the Z2 direction, see FIG. 6A) and can be connected to a circuit board B1 arranged in the Z2 direction with respect to the first connector. The third edge part 17 is formed on the edge of the front part 113*b* of the second extending part 113 in the Y1 direction. The third edge part 17 is formed on the edge of the front part 113*b* of the second extending part 113 in the Y1 direction and is positioned more in the Y1 direction than the main body part 111. The third edge part 17 protrudes from the front surface 30*b* of the housing 30 (the surface facing the Y1 direction, see FIG. 6A) and can be connected to a circuit board B2 arranged in the Y1 direction with respect to the first connector 1.

The first metal member 110A and the second metal member 110B may have substantially the same shape. The second metal member 110B is retained by the housing in an orientation in which the first metal member 10A is inverted with respect to the straight line L1 along the Y-axis direction. Thus, the relative positions of the main body part 111, the first edge part 15, the second edge part 16, and the third edge part 17 in the second metal member 110B are substantially the same as their relative positions in the first metal member 110A.

As illustrated in FIG. 10B, the first edge part 15 of the second metal member 110B is positioned more in the Z2 direction with respect to the main body part 111. The first edge part 15 can be attached to a circuit board B1 protruding in the Z2 direction from the lower surface 30*a* of the housing 30 (the surface facing in the Z2 direction, see FIG. 7A) and arranged in the Z2 direction with respect to the first connector 1. The third edge part 17 of the second metal member 10B may be positioned more in the Y1 direction than the main body part 111. The third edge part 17 can be attached to a circuit board B2 (see FIG. 3) that protrudes in the Y1 direction from the front surface 30*b* of the housing 30 (the surface facing in the Y1 direction, see FIG. 7A) and arranged in the Y1 direction with respect to the first connector 1.

In this configuration, the second edge part 16 of the first metal member 110A and the first edge part 15 of the second metal member 110B are separated in the Y-axis direction in a side view of the first connector 1 (when viewing the first connector 1 in the X-axis direction). This arrangement can prevent the end in the Y2 direction of the first connector 1 from separating from the circuit board B1 when the cable 93 is pulled in an oblique direction (direction between the Y1 and Z1 directions) while the first connector 1 is mounted on the circuit board B1. In addition, when the cable 93 is pulled in an oblique direction (the direction between the Y2 and Z1 directions) while the first connector 1 is mounted on the circuit board B1, the end part in the Y1 direction of the first connector 1 can be prevented from separating from the circuit board B2.

Figure 11A:
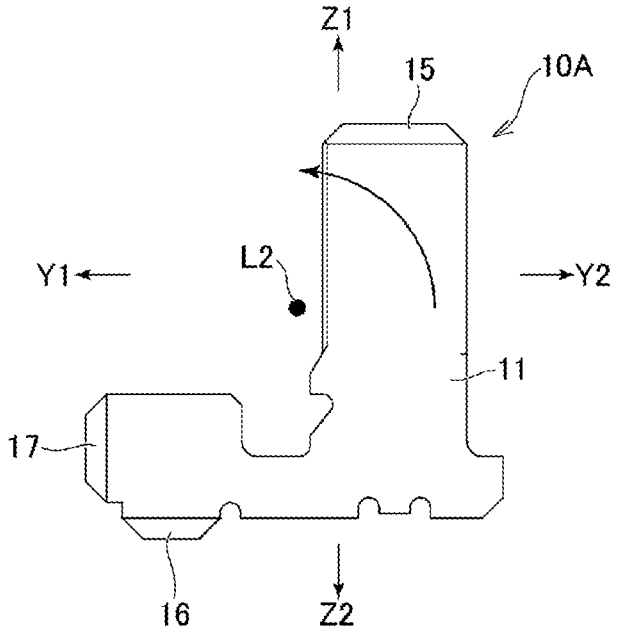
FIGS. 11A and 11B are side views illustrating a modified example of the second metal member.
Figure 11B:
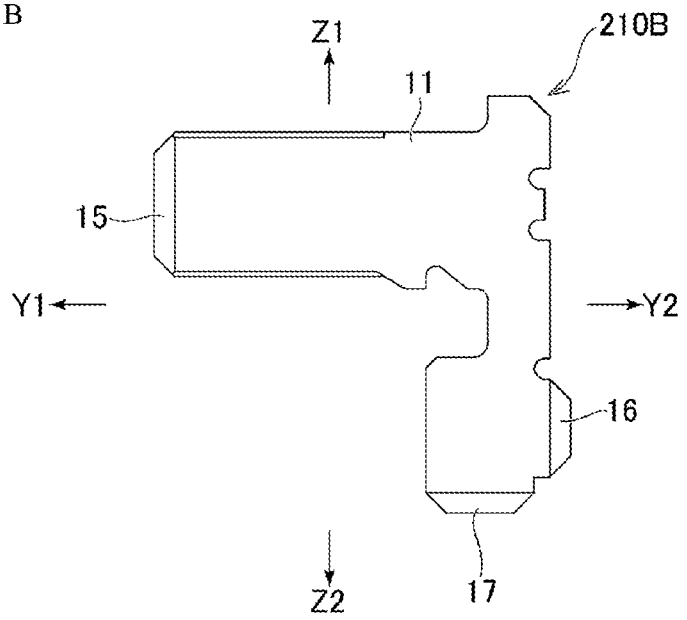

As yet another example, while the first metal member 10A is inserted into the retaining hole 32*a* formed in the housing 30 in the Z1 direction, the second metal member 10B may be inserted in the Y1 direction with respect to a retaining hole open in the Y2 direction or may be inserted in the Y2 direction with respect to a retaining hole open in the Y1 direction. FIGS. 11A and 11B are diagrams for describing such a configuration. FIG. 11A is the first metal member 10A described above. FIG. 11B illustrates the second metal member 210B. The second metal member 210B is retained by the housing 30 in an orientation in which the first metal member 10A is rotated about a straight line L2 in the X-axis direction. Specifically, the second metal member 210B is retained by the housing 30 in an orientation in which the first metal member 10A is rotated 90 degrees. In this case, the second metal member 10B may be inserted in the Y1 direction into a retaining hole that is open in the Y2 direction. The single structure of the second metal member 210B may be the same as the structure of the second metal member 10B.

In the example of FIGS. 11A and 11B, the first edge part 15 of the second metal member 210B is positioned more in the Y1 direction than the main body part 11. When the second metal member 210B is attached to the housing 30, the first edge part 15 protrudes in the Y1 direction from the front surface 30*b* of the housing 30 (the surface facing in the Y1 direction, see FIG. 7A) and can be attached to the circuit board B2 arranged in the Y1 direction with respect to the first connector 1. The third edge part 17 of the second metal member 210B is positioned more in the Z2 direction than the main body part 11. The third edge part 17 protrudes in the Z2 direction from the lower surface 30*a* (the surface facing in the Z2 direction) of the housing 30 and can be attached to the circuit board B1 arranged in the Z2 direction with respect to the first connector 1. The second edge part 16 of the second metal member 210B is positioned more in the Y2 direction than the main body part 11 of the second metal member 210B.

The invention claimed is:

1. A connector, comprising:

first metal members that function as terminals;

second metal members that function as reinforcing brackets; and a housing that retains the first metal members and the second metal members, wherein the connector connects with a mating connector in a first axis direction, each of the first metal members and second metal members include a main body part, a first edge part, a second edge part, and a third edge part, the main body part of the first metal member includes a portion in contact with a mating terminal, the first edge part of the first metal member is positioned in a first direction that is one direction in the first axis direction from the main body part, the second edge part of the first metal member is positioned in a second direction opposite to the first direction that is in the first axis direction from the main body part and can be connected to a first circuit board arranged in the second direction of the connector, the third edge part of the first metal member is positioned in a third direction that is one direction in a second axial direction orthogonal to the first axis direction from the main body part and can be connected to a second circuit board arranged in the third direction of the connector, the second metal member is retained in a different orientation from the first metal member, the first edge part of the second metal member is positioned in the second direction from the main body part of the second metal member and can be attached to the first circuit board arranged in the second direction with respect to the connector, the third edge part of the second metal member is positioned in the third direction from the main body part of the second metal member and can be attached to the second circuit board arranged in the third direction in respect to the connector, and the second edge part of the second metal member is positioned in the first direction from the main body part of the second metal member.

2. The connector according to claim 1, wherein the first metal member and the second metal member have the same shape in at least one of the main body part, the first edge part, the second edge part, or the third edge part.

3. The connector according to claim 1, wherein the relative positions of the main body part, the first edge part, the second edge part, and the third edge part regarding the second metal member are the same as the relative positions of the main body part, the first edge part, the second edge part, and the third edge part regarding the first metal member.

4. The connector according to claim 1, wherein the first metal member and the second metal member have substantially the same shape.

5. The connector according to claim 1, wherein the main body part of the first metal member and the main body part of the second metal member both have a first extending part and a second extending part that is connected to the first extending part and extends in a direction intersecting the first extending part, the first edge part is formed on the first extending part, and the second edge part and the third edge part are formed on the second extending part.

6. The connector according to claim 1, wherein the first edge part of the second metal member is positioned in the second direction from the main body part of the second metal member and can be attached to the first circuit board arranged in the second direction with respect to the connector, and the second edge part of the first metal member and the first edge part of the second metal member are separated in the second axis direction.

7. The connector according to claim 1, wherein the third edge part of the second metal member is positioned in the third direction from the main body part of the second metal member and can be attached to the second circuit board arranged in the third direction in respect to the connector, and the third edge part of the first metal member and the third edge part of the second metal member are separated in the first axis direction.

8. The connector according to claim 1, wherein a first retaining hole and a second retaining hole are formed in the housing into which the first metal member and the second metal member are respectively inserted, the first metal member can be inserted into the first retaining hole in the first direction, and the second metal member can be inserted into the second retaining hole in the second direction.

9. The connector according to claim 1, wherein each of the first metal member and the second metal member has an extending part that extends in the second axis direction, the housing has a first stopper part that is positioned in the first direction with respect to the extending part of the first metal member and restricts movement of the first metal member, and the housing has a second stopper part that is positioned in the second direction with respect to the extending part of the second metal member and restricts movement of the second metal member.

10. A connector, comprising:

first metal members that function as terminals;

second metal members that function as reinforcing brackets; and a housing that retains the first metal members and the second metal members, wherein the connector connects with a mating connector in a first axis direction, each of the first metal members and second metal members include a main body part, a first edge part, a second edge part, and a third edge part, the main body part of the first metal member includes a portion in contact with a mating terminal, the first edge part of the first metal member is positioned in a first direction that is one direction in the first axis direction from the main body part, the second edge part of the first metal member is positioned in a second direction opposite to the first direction that is in the first axis direction from the main body part and can be connected to a first circuit board arranged in the second direction of the connector, the third edge part of the first metal member is positioned in a third direction that is one direction in a second axial direction orthogonal to the first axis direction from the main body part and can be connected to a second circuit board arranged in the third direction of the connector, the second metal member is retained in a different orientation from the first metal member, the first edge part of the second metal member is positioned in the third direction from the main body part of the second metal member and can be attached to the second circuit board arranged in the third direction in respect to the connector, the third edge part of the second metal member is positioned in the second direction with respect to the main body part of the second metal member and can be attached to the first circuit board arranged in the second direction with respect to the connector, and the second edge part of the second metal member is positioned in the fourth direction that is opposite to the third direction in the second axis direction from the main body part of the second metal member.

11. A connector assembly, comprising:

a first connector; and a second connector that mates with the first connector in a first direction, where the connector includes:

first metal members that function as terminals;

second metal members that function as reinforcing brackets; and a housing that retains the first metal members and the second metal members, wherein each of the first metal members and second metal members include a main body part, a first edge part, a second edge part, and a third edge part, the main body part of the first metal member includes a portion in contact with a terminal of the second connector, the first edge part of the first metal member is positioned in a first direction that is one direction in the first axis direction from the main body part, the second edge part of the first metal member is positioned in a second direction opposite to the first direction in the first axis direction from the main body part and can be connected to a first circuit board arranged in the second direction of the first connector, the third edge part of the first metal member is positioned in a third direction that is one direction in a second axial direction orthogonal to the first axis direction from the main body part and can be connected to a second circuit board arranged in the third direction of the first connector, the second metal member is retained in a different orientation from the first metal member, the first edge part of the second metal member is positioned in the second direction from the main body part of the second metal member and can be attached to the first circuit board arranged in the second direction with respect to the first connector, the third edge part of the second metal member is positioned in the third direction from the main body part of the second metal member and can be attached to the second circuit board arranged in the third direction with respect to the first connector, and the second edge part of the second metal member is positioned in the first direction from the main body part of the second metal member.

12. A connector assembly, comprising:

a first connector; and a second connector that mates with the first connector in a first direction, where the connector includes:

first metal members that function as terminals;

second metal members that function as reinforcing brackets; and a housing that retains the first metal members and the second metal members, wherein each of the first metal members and second metal members include a main body part, a first edge part, a second edge part, and a third edge part, the main body part of the first metal member includes a portion in contact with a terminal of the second connector, the first edge part of the first metal member is positioned in a first direction that is one direction in the first axis direction from the main body part, the second edge part of the first metal member is positioned in a second direction opposite to the first direction in the first axis direction from the main body part and can be connected to a first circuit board arranged in the second direction of the first connector, the third edge part of the first metal member is positioned in a third direction that is one direction in a second axial direction orthogonal to the first axis direction from the main body part and can be connected to a second circuit board arranged in the third direction of the first connector, the second metal member is retained in a different orientation from the first metal member, the first edge part of the second metal member is positioned in the third direction from the main body part of the second metal member and can be attached to the second circuit board arranged in the third direction with respect to the first connector, the third edge part of the second metal member is positioned in the second direction with respect to the main body part of the second metal member and can be attached to the first circuit board arranged in the second direction with respect to the first connector, and the third edge part of the second metal member is positioned in the fourth direction that is opposite to the third direction in the second axis direction from the main body part of the second metal member.

* * * * *